United States Patent [19]

Alm et al.

[11] 4,330,346

[45] May 18, 1982

[54] CAP-SENSITIVE POWDERED EXPLOSIVE COMPOSITION

[75] Inventors: Oddvar Alm, Drammen; Bjarne Andersen, Hyggen; Eirik Samuelsen, Lier, all of Norway

[73] Assignee: Dyno Industrier A.S., Oslo, Norway

[21] Appl. No.: 152,152

[22] Filed: May 21, 1980

[30] Foreign Application Priority Data

Jun. 1, 1979 [NO] Norway ..... 791830

[51] Int. Cl.[3] ..... C06B 45/02

[52] U.S. Cl. ..... 149/21; 149/43; 149/44; 149/114

[58] Field of Search ..... 149/21, 43, 44, 114

[56] References Cited

U.S. PATENT DOCUMENTS 3,333,998 8/1967 Ferguson ..... 149/21

*Primary Examiner*—Stephen J. Lechert, Jr.

*Attorney, Agent, or Firm*—Wenderoth, Lind & Ponack

[57] ABSTRACT

A cap-sensitive explosive composition in powder form contains, in addition to ammonium nitrate as its single oxygen releasing component, and optional components commonly used in explosive compositions, four components within specific weight ranges, calculated on the basis of the weight of the explosive composition:

(a) 3 to 8% of a combustible liquid consisting of one or more completely water soluble components, having a boiling temperature of above 120° C., and being capable of dissolving ammonium nitrate in amounts of between 20 grams and 100 grams per 100 grams of said liquid without reacting chemically with ammonium nitrate;

(b) 0.5 to 2.5% of a water blocking agent consisting of a high molecular weight polysaccharide having the property of imparting high viscosity to an aqueous, saturated ammonium nitrate solution;

(c) 0.5 to 3% of a water-insoluble wax or waxy substance in finely pulverized form;

(d) 1 to 6% of an aluminium powder the particles of which are in flake form and which have a specific surface of at least 5000 $cm^2$ per gram.

6 Claims, No Drawings

CAP-SENSITIVE POWDERED EXPLOSIVE COMPOSITION

The present invention relates to powder explosive compositions having no explosive components and having ammonium nitrate as the single oxygen releasing component. The present explosive compositions are cap-sensitive, relatively water resistant, readily cartridgeable, non-sintering during storage and possess densities of between 1.05 and 1.25 grams per $cm^3$.

Powder explosives have been produced for many years and the majority have been based on ammonium nitrate (AN) and nitric esters of glycol and glycerine. The said explosives have been cap-sensitive, they have been relatively resistant to water in the boreholes, they have had a somewhat cohesive powder consistency which makes them easy to cartridge and prevents spills when a cap is inserted into a cartridge, and they have essentially had densities of between 1.10 and 1.20 grams per $cm^3$. The use of said nitric esters ("blasting oil"), however, and, optionally, also the nitrocellulose, raise certain hazards, including certain unfortunate physiological effects, which have not been avoidable during the preparation and use of the explosives.

Consequently, several proposals have been made for nitroglycerine-free powder explosives. Some of the said proposed compositions beside AN, have contained trinitrotoluene or other nitroaromatics, which substances may be said to be less hazardous than is the case with the nitric esters; however, the use of nitroaromatics has not totally eliminated those effects.

Some explosives used for practical blasting purposes have been totally free from nitro compounds and, in their simplest form, have consisted of AN and a fuel oil, although the use of other combustible components, and also water soluble components such as glycol, has been proposed.

A common feature of all hitherto proposed powder nitroglycerine-free explosive has been that, in one or more ways, they have not been of the same quality as the nitroglycerine-containing powder explosives in the sense of advantageous properties of quality.

Cap-sensitivity, thus, has been achieved only with a significant content of nitroaromatics, or by an excessive grinding of the AN used, or by a particularly high porosity of AN, or by specific process steps such as heating and cooling of the powder mass. Thus, for compositions which are not sufficiently sensitive, one has often been forced to use transition charges or so-called primers in the use of such nitroglycerine-free explosives.

Generally, the water resistance has been significantly less than that of the nitroglycerine-containing explosives, so that they have been almost useless in water-filled boreholes. In addition, the storage stability has frequently been inferior, either in the sense that the cap-sensitivity has disappeared after a certain time or that the powder mass has sintered so that the introduction of a cap into a cartridge has been made difficult or that other quality parameters have changed during storage.

Various proposals have been made, particularly for obtaining a certain water resistance. Thus, the application of a hydrophobic layer on the surface of the AN particles has been tried, such as by the fusing of a nitroaromatic compound on the surface, or by the application of a layer of silicone.

All these measures have had a very limited effect, probably because the penetration of even small amounts of water to the AN crystals causes an increase in volume during the formation of an AN-water-solution, and thereby a breakdown of the hydrophobic layer. Other proposals for the improvement of the water resistance have included the addition of a highly polymerised colloidal water soluble compound cabable of swelling and hydrating in the presence of AN, and of such compounds as galactomannans in the form of guar gums. These substances apparently act as blocking agents against the penetration of water into the powder mass by hydrating with the first part of the water which penetrates the mass and thus developing a phase with greatly increased viscosity, which in turn to a high degree retards or stops the continued penetration of water. It has also been proposed, as in U.S. Pat. No. 3,640,784, to use as the water blocking agent a so-called self-crosslinking guar gum which, by means of certain additives, has been given the property of imparting a visco-elastic gel structure to the water phase after the hydration.

In the use of such a self-crosslinking guar gum, however, it has proved necessary at the same time to include a buffering substance, for instance ammonium phosphate, in the explosive formulation, and such substances represent substantially inert components in the detonation process in the explosive.

It can be said that for all powder nitroglycerine-free explosives which have been proposed or used, the water resistance will be insignificant unless some measure has been taken to establish such a property. Thus, a number of explosives based on AN, are described in French Patent Specification No. 2,086,735, with water-insoluble as well as water-soluble combustible components, e.g. ethylene glycol and hexylene glycol, without any form of hydrophobation of the AN particles or any addition of a water blocking agent. These explosives demonstrate a modest water resistance.

Many of the proposed nitroglycerine-free powder explosives have had the characteristic of being essentially completely free-flowing powder with little or no coherence in the powder mass. This has been a drawback in mechanical cartridging, as spills readily occur in and around the cartridging equipment. It is also a drawback when a cap is to be inserted in a cartridge or, if the explosive cartridges are to be forced to rupture by the use of a charging rod, particularly in boreholes which are inclined upwards.

On the other hand it is a drawback if the powder mass has too great a tendency to sinter, especially if the cartridges after a period of storage become so hard that introducing a cap into the powder mass is made difficult. In general, such sintering occurs easily in slightly damp powdered ammonium nitrate, whereas a certain content of water-insoluble liquids, such as nitroglycerine and diesel oil, greatly reduces the tendencies to sinter.

Aluminium, because its very great combustion heat adds considerably to the explosive energy of an explosive, is among the components often proposed for powder explosives. Aluminium is often used in one of two essentially different forms. One form comprises substantially ball-like particles produced in a process known as atomizing. This form contributes only to the energy of the explosive, and not to the other important properties. The second form consists of flakes of different sizes, produced either by deformation of ball-like particles in a ball mill or by breaking up rolled foils, and is characterized by having a considerably larger surface per unit of weight than when in the atomized state. Such flake aluminium reacts far more easily and rapidly as a component of an explosive than does the atomized quality, and can, therefore, assist in furthering the initiation sensitivity to such an extent that such aluminium powder is often referred to as a sensitizer.

The aim of the present invention is to provide a powder explosive composition with essentially all the favourable quality features demonstrated by explosives containing nitroglycerine, but without making use of any per se explosive component or any physiologically undesirable component. The aim of the present invention is thus an explosive composition comprising simultaneously the following desirable properties:

- A high energy, variable within certain limits as desired and required through moderate adjustments of the composition.
- An excellent water resistance, ensuring good detonative performance even after the powder has been exposed to water.
- Cap-sensitivity, meaning that ignition is consistently achieved using cap No. 8, and often using No. 6 (of Euorpean make).
- Good cartridgeability, which prevents spills and ensures well filled cartridges of consistent weight.
- Absence of tendency to sinter in the powder mass, enabling it to retain its desired coherence and facilitating the introduction of a cap even after extended storage time.
- A density in the powder mass of about 1.05 grams per $cm^3$ or more, which makes it possible to use explosive cartridges in water-filled boreholes.
- A critical diameter which is less than 50 mm and which is variable by moderate adjustments in the composition down to about 20 mm as desired or required in accordance with the boreholes in which the explosive is to be used.

The present invention consists of a powder explosive composition in which all the following four components in addition to ammonium nitrate, are present:

(a) a combustible liquid consisting of one or more completely water soluble components, having a boiling temperature of above 120° C., and being capable of dissolving ammonium nitrate in amounts of between 20 grams and 100 grams per 100 grams of said liquid without reacting chemically with ammonium nitrate;

(b) a water blocking agent consisting of a high molecular weight polysaccharide having the property of imparting high viscosity to an aqueous, saturated ammonium nitrate solution;

(c) a water-insoluble wax or waxy substance in finely pulverized form;

(d) an aluminium powder the particles of which are flaky and have a specific surface of at least 5000 $cm^2$ per gram.

In addition to these necessary components, the explosive of the invention may comprise other solid particulate combustible components, of which atomized aluminium is especially relevant in the selection of a desired energy content. Atomized aluminium allows this to be done more economically than by increasing the contents of the aluminium flakes beyond what is necessary for other reasons.

It has been found that several factors may interact to give a particular property to the explosive composition, and it is recognised that one and the same component of the explosive composition may effect several properties. The present invention is thus based on the fact that, by certain selected combinations of components, a number of properties of quality are obtained which might otherwise only have been obtainable by use of increased amounts of the most active component.

Thus, it has been found that a combustible organic liquid which dissolves a certain amount of AN, improves the sensitivity of the explosive, and that a certain amount of flake aluminium, which would in itself be insufficient to establish cap-sensitivity in a powder explosive not having been sensitized in any other way, imparts, together with the AN-dissolving organic liquid, the explosive composition with such cap-sensitivity.

The AN-dissolving organic liquid has, moreover, the effect of rendering the powder mass favourably cohesive, making the product readily cartridgeable.

Further, it has been found that flake aluminium, in amounts in excess of those giving cap-sensitivity together with the AN-dissolving liquid, influences the critical diameter of the explosive composition and the cartridge diameter in which it can be used for practical purposes.

1% flake aluminium is sufficient to give cap-sensitivity and a critical diameter in the range of from 32 to 50 mm. With a content of flake aluminium of about 3%, and with only a certain adjustment in the content of the wax component, a critical diameter of about 22 mm is easily obtained. This is considered as being functionally sufficient for cartridge diameters of about 35 mm or more. If the content of flake aluminium is increased further to approach 5%, a critical diameter of 17 mm is readily obtained, as well as an explosive for practical use in cartridges of a diameter of 25 mm.

It has, moreover, been found that flake aluminium, even in amounts of about 1%, has a positive influence on the water resistance when used together with a water blocking agent of the polysaccharide type. The flake aluminium thus has two markedly different and favourable effects, namely on the water resistance as well as on the sensitivity, expressed in terms of detonator sensitivity as well as critical diameter.

It has also been found that even with both flake aluminium as well as a water blocking agent of the polysaccharide type present in the explosive composition, a further improved water resistance is often obtained by using so simple a hydrophobic substance as wax. The water resistance in the explosive composition according to the invention can thus be established by means of three components: a water blocking agent of the polysaccharide type, the flaky aluminium, and a wax. To be effective, the wax must be finely pulverized, since it is then sufficient to introduce it into the explosive composition by means of a simple mixing process, without any form of fusion process at elevated temperatures.

It has also been found that through the presence of such a finely pulverized wax, a favourable effect on the consistency of the powder mass is obtained, in as far as it counteracts the tendencies to sinter which are otherwise present. This would appear to be of particular practical importance when a content of liquids capable of dissolving some ammonium nitrate, is high enough to give a density in the powder mass of more than about 1.10 grams per $cm^3$. With a practical cartridge density of 1.15 or more a balance should be aimed at between the cohesive effect of the liquid component and the anti-sintering effect obtained by the presence of a waxy component.

This wax, which may in its simplest form be a paraffin wax consisting of hydrocarbons, but which may also contain some oxygen, e.g. in the form of ester bonds, also represents a comparatively energetic fuel in the explosive composition. Variations in the contents of this wax will, therefore, serve the purpose of adjusting the composition to a desired oxygen balance, when the requisite or desirable contents of combustible organic liquid, flake aluminium and, optionally, also atomized aluminium or other components have been determined.

The combustible liquid which is capable of dissolving some AN is centrally placed as a component of explosive compositions according to the invention. It is to have a positive effect on the sensitivity of the explosive composition and is to impart to the powder mass a degree of cohesion so as to achieve good cartridgeability and a favourably high cartridge density. It is, moreover, a practical requirement that this liquid shall not be so volatile as to enable it to evaporate to any noticeable extent from the explosive composition during storage. A suitable specification in this respect is that the liquid shall have a boiling temperature of over 120° C., which at the same time in practice excludes readily combustible liquids. It is, moreover, an environmental requirement that the liquid shall not be toxic or entail any other noticeable physiological disadvantages during handling and use. It is finally a requirement, arrived at during experimental work, that the liquid shall be water soluble. It is probable that this is connected with the water blocking effect displayed by the polysaccharide, since the liquid in question, which will during the preparation of the explosive moisten the dry polysaccharide particles, should not prevent but rather facilitate the access of water to the water blocking agent.

Five different, pure liquid substances have been found, each of which is suitable as a liquid component of an explosive composition according to the invention. Their abilities to dissolve AN, as well as the densities of the AN-saturated solutions, has been experimentally determined at about 20° C., with an accuracy sufficient to realize their common features of importance for the invention. These substances, with the indication of their boiling temperatures and the experimentally found data, are Nos. 1 to 5 of Table 1:

TABLE 1

| No. | | Boiling point at 1 atm. | Grams of AN dissolved in 100 grams of liquid | Density of AN-saturated solution |
|---|---|---|---|---|
| 1 | Formamide | 210° C. | 94 | 1.30 |
| 2 | Ethylene glycol | 197° C. | 43 | 1.20 |
| 3 | Propylene glycol | 189° C. | 24 | 1.11 |
| 4 | Diethylene glycol | 244° C. | 38 | 1.20 |
| 5 | 2-methoxy ethanol | 124° C. | 25 | 1.05 |
| 6 | 2 ethoxy ethanol | 135° C. | 4 | 0.96 |
| 7 | Mixture of Nos. 1 and 6 in the ratio 1:1 | — | 42 | 1.15 |

It has thus been found that suitable limits for the solubility of AN are between 20 and 100 grams of dissolved AN per 100 grams of the liquid in question. The relevant liquids all having a boiling temperature of above 120° C. at atmospheric pressure.

Substance No. 6 in Table 1, 2-ethoxy ethanol (glycol monoethyl ether with trade names "Cellosolve" and "Oxitol") therefore falls outside of the scope of a suitable liquid component in so far as it dissolves only 4% of its weight of ammonium nitrate. It will, however, be seen that this liquid in a 1:1 mixing ratio with formamide gives a suitable liquid composition, and it is not a requirement of the present invention that the liquid component shall be a pure chemical compound. Also solid, water soluble substances may be included in such a liquid component, and in this connection substances such as acetamide and hexamethylene tetramine can be mentioned as relevant ingredients. However, it is a condition that none of the liquid components can react chemically with AN.

Although the liquid component of the explosive composition is preferably selected from the first five substances of Table 1, others may be used on condition that the following criteria are fulfilled regarding said liquid component:

complete water-solubility solubility for AN between 20 and 100 grams of AN per 100 grams liquid boiling point at 1 atmosphere of at least 120° C.

It should also be mentioned that during determination of the solubility of AN in these liquids, it was observed that AN crystallized very slowly and in the shape of dense, small crystals from over-saturated solutions at room temperature. This may be seen as a partial explanation of why sintering tendencies during storage are essentially absent in explosive compositions according to the invention. It would appear probable that a limited solubility and a low crystallization rate for AN in the liquids in question imply a lower recrystallisation tendency than is the case in a system of AN and water, and that this assists in reducing the sintering conditions in the powder mass.

As regards the amounts of said liquid component which it is necessary or suitable to use in explosive compositions according to the invention, it may in principle be said that amounts of about 3% of the finished composition give noticeable effects both on the sensitivity and desired coherence and at the same time the density of the powder mass is increased to a level noticeably above the density of the said AN-powder-mass without added liquid.

On the other hand, addition of more than 8% liquid will give an unnecessarily or unsuitably high cohesion, giving the powder mass more the character of being moist. At the same time, the density of the powder mass increases so that, with the degree of compaction prevailing during cartridging, the density will reach 1.2, or even 1.25 grams per $cm^3$. At the same time it may be observed that the cap-sensitivity decreases or disappears, or will be very dependent on the degree of compaction during cartridging.

Generally speaking, it may be said that with the addition of liquid within the limits 3 and 8%, based on the finished powder composition, desirable and suitable degrees of cohesion, density and sensitivity can be obtained.

The flake aluminium powder constituting an essential and characterizing ingredient in explosive compositions according to the invention, is preferably a commercially available article often described as "paint grade" aluminium. Normally, this article is protected against the adverse effect of the humidity and the oxygen of the air by a certain small addition of e.g. stearic acid. The nature and amount of this addition is of secondary importance in connection with the present invention. Moreover, such an article is characterized by having a certain specific surface, determinable by known methods by spreading on water. A minimum for this specific surface would appear to be around 5000 $cm^2$ per gram, while values of up to 10,000 $cm^2$ per gram or even higher may be usefully applied in certain situations.

The high molecular weight polysaccharide of the galactomannan type preferably used in the explosive composition according to the present invention as a water blocking agent, is commercially available under the term of guar gum. Of this article, a number of grades of different origins exist, of various purities as polysaccharide and having different degrees of molecular degradation of the natural polysaccharides. Neither a particularly high nor particularly low viscosity in an aqueous solution of said polysaccharides are of special importance to the present invention, but it is preferred that the article be of a comparatively finely ground type, displaying rapid swelling and hydration in pure water as well as in an aqueous AN-solution.

The wax employed in the present invention may be of various nature and origin, and for reasons of economics a comparatively cheap paraffin wax has been preferred and found satifactory. It is however, a condition that it be used in the form of a fine powder easily mixed into the mass of the other powdered components.

The contents of the water blocking agent, the wax component and the flake aluminium component in the explosive composition according to the invention are from 0.5 to 2.5 percent by weight, from 0.5 to 3 percent by weight, and from 1 to 6 percent by weight respectively, based on the explosive composition.

The AN which constitutes by weight a dominant component of explosive compositions according to the invention can be selected from amongst several different commercially available types. Common to the commercial AN-grades is, however, the fact that they are relatively coarsely grained, mostly because the tendency inherent in AN of sintering during storage is thereby avoided or reduced, and such coarsely grained AN is not suitable in the preparation of explosive compositions according to the invention without first being crushed. A very easily crushed, porous form of medium sized AN-prills, as well as a very dense and hard form of very large AN-prills, beside a crystalline article, have successfully been used as raw material after being crushed in a pin-type mill. It is, however, preferred to avoid the use of the most easily crushed prills, although products of high sensitivity are readily obtained thereby, because the crushed AN in that case is dusty to an unpleasant extent and causes inconvenience to the persons handling the AN.

Crushing of the raw material AN so that at least half of the crushed material will pass through a sieve with openings of 0.21 mm is generally preferred.

In the working examples listed below, all components involved are stated with the descriptions used by the suppliers as well as with characterizing quality as far as has been possible or has been found necessary.

In principle, there are no critical features in the method of preparing an explosive composition according to the invention, as this is defined by the contents of the four requisite components mentioned above, and the AN. In certain instances it has been found convenient to introduce the liquid component first into a chargewise operating mixing machine, thereafter a smaller amount of AN, to saturate the liquid with AN during stirring of a liquid dispersion, and only then to introduce the remaining dry and powdery components, which may well have been reasonably evenly intermixed in advance. In this way the liquid will not be unevenly distributed in the mass as liquid-containing sintered lumps.

However, handling of flake aluminium represents a considerable hazard as to fire and explosive dust, which should, at least during preparation of explosives, be avoided by all available means.

Because an explosive composition according to the invention comprises both such flake aluminium powder and an organic, not readily flammable liquid it is an advantage which is considered as a preferred embodiment, that these two components can be combined to an intermediate product for the preparation of explosives in the form of a non-dusty, hazard-free readily handled dispersion of aluminium particles in said liquid.

Thus, flake aluminium may be dispersed in glycol to form a paste-like mass in the weight ratio of 6 parts of aluminium to 4 parts of glycol. Such a paste can be introduced into the mixing machine as the final component without creating badly mixed zones in the powder mass.

The preparing of such an aluminium powder dispersion during which dry aluminium powder is handled, should naturally be located at a safe distance from the actual explosive preparation.

It is, however, a known technology with the manufacturers of aluminium powder to prepare such dispersions or pastes, and according to the liquid components desired to be included in the explosive compositions of the invention, the nature and the combination of such a paste supplied from these manufacturers can be specified.

It will, however, be realised that the use of a paste of the liquid component and flake aluminium is only a preferred method in the preparation of an explosive composition according to the invention, and that other precautions for avoiding the hazard of fire and/or dust explosions when introducing the flake aluminium can also be used. There are thus available so-called dust-free grades of such flake aluminium, characterized by the particles having been surface treated in a special way to create heavier, non-dusty agglomerates which are, however, during a mixing process with larger amounts of ammonium nitrate, easily broken down to give the readily reacting flaky particles giving fully the desired effects on the quality properties of the explosive.

Considering all these circumstances, it appears as a favourable and characteristic feature of the present invention that the explosive composition concerned may be prepared by a moderately simple mixing process using commercially available, hazard-free components.

As compared with all previously known powder explosives, an explosive composition according to the invention thus has a novel and characteristic advantage, namely, as compared with explosives containing nitro compounds, that it may be prepared from completely hazard-free components, and as compared with the explosives previously suggested prepared from such hazard-free components, that it possesses a combination of favourable characteristics of quality.

Also compared with slurry explosives, the invention entails the same advantages, because, even when containing no explosive ingredients, these at least are conditional on the preparation of certain solutions employing heating systems or the like.

It has not been found that the presence of oxygen releasing salts other than AN in explosive compositions according to the invention has any favourable effect on the properties of the explosive composition. On the contrary, the storage stability is thereby reduced, because sintering may readily occur, causing inconvenience in use. It is believed that such sintering is connected with a certain increased tendency to recrystallization when the AN obtains contact with other salts, or that the combination of several salts reduces the equilibrium vapour pressure of water to make the combination more water attracting. The use of salts other than AN therefore lies outside of the scope of the invention.

It also lies outside of the scope of the invention to use as components of the composition density increasing substances, such as ferro silicon, ferro phosphorus and the like as well as inert components such as alkaline earth hydroxides and the like which are disclosed in U.S. Pat. No. 3,640,784, partly because such components would serve no purpose of the invention, partly because the use of an AN-dissolving liquid in the amounts stated in this present specification permits the preparation of powdery explosive compositions of densities in the range of from 1.05 to 1.25 grams per $cm^3$. When in addition thereto, the use of self-crosslinking polysaccharides are not included in the present invention, this should be clearly distinguished over the invention of the mentioned patent, even if said patent mentions powder explosives simultaneously containing glycol as well as guar gum.

To assess the various properties which will be of importance during practical use of explosive compositions according to the invention, a number of test methods have been employed for which no standardized or otherwise descriptive details are available. In the following, those details are therefore described which may be considered necessary for a practical reproduction of the observations referred to in the working examples.

Cap-sensitivity is defined in this connection as that property in an explosive which brings it to detonation when initiated with a blasting cap (of European make) of size No. 8 (or lower number) inserted into one end of the charge, and that the detonation propagates through the entire charge when this is 50 mm (or less) in diameter and 200 mm (or less) in length, and the explosive is enveloped in a PVC tube with a wall thickness of about 0.4 mm or in a thinner plastic film. The density of the charge should not deviate essentially from that obtained by a realistic cartridging process, and generally about 1.15 grams per $cm^3$ is to be preferred. The temperature of the charge is preferably +5° C., but no particular temperature dependency has been observed in these sensitivity tests of the explosive compositions according to this invention.

The smallest initiation charge is the size of blasting caps, in the series 4, 6 and 8, which, under the said test conditions, gives complete detonation, and is usually tested in 25 mm diameter. The critical diameter is the smallest charge diameter, in the series 17, 22, 25, 32, and 40 mm which, under the said test conditions, gives complete detonation, and is usually tested with a No. 8 blasting cap.

Water resistance is assessed by comparing the brisance of a sample of explosive into which water has penetrated, with the brisance of the dry explosive. The brisance is measured as the compression of a lead cylinder of 40 mm diameter and 65 mm height, upon which a steel disc of 40 mm diameter and 5 mm thickness has been placed, and upon which 125 grams of explosive in direct contact with the steel disc, usually packed to a density of from 1.10 to 1.15 grams per $cm^3$, is placed. The explosive is initiated by a No. 8 blasting cap. The conditions of water penetration are defined in that the charge and the metal cylinders, with a common wrapping of porous filter paper in a double layer, are placed in a bath containing water and lumps of ice, and that the charges are retrieved from said bath and initiated as soon as possible with a No. 8 blasting cap, after retention times of 1 or 2 hours respectively. (This test has been proved to discriminate excellently between explosives of very low water resistance, in which no measurable brisance is obtained after less than 1 hour, and very water resistant explosives, in which a considerable percentage of the brisance of the dry explosive is still present after 2 hours).

Cartridgeability is a less exactly defined property in powder explosives, but as mentioned above, a certain cohesion is of importance to avoid spills of explosives in and around cartridging equipment. In a cartridging method in which the explosive is introduced into a cartridge casing by means of a feed screw, it is on the other hand important that the consistency of the explosive is not too "moist", as it will then be compressed too much (to densities of more than 1.25 grams per $cm^3$) or even be packed solid during such cartridging process. A practically useful "cartridgeability" would generally seem to imply that a portion of the powder explosive retains its shape after a heavy compression by hand, and that such a portion is also readily crumbled again with the fingers.

In the working examples described below, a number of commercially available raw materials have been used, being identified by certain trade names. For a fuller description of the qualities of these components, the data which may be assumed to be of importance to the effects of the components in the explosive compositions according to the invention are listed here. Any raw material of approximately identical qualities of those listed here should presumably give the same results and it is not known that any of the raw materials used should possess properties of importance to the quality of the explosive apart from what is set out here.

| Type: | CB 105 VT | CB 180 VT | Alcoa 1651 | Alcoa 1663 |
|---|---|---|---|---|
| Covering capacity on water $cm^2$ per gram, approximately | 8000 | 14000 | 7000 | 15000 |
| Stearic acid, content % | 3.0 | 3.0 | 2.0 | 2,5 |
| Anti-dust treated with about 2% "Teflon" | No | No | Yes | Yes |

| Atomized aluminum. Type A 60-80 | | |
|---|---|---|
| Particles coarser than | 0.21 | mm: Max 5% |
| Particles between 0.21 and | 0.053 | mm: Min. 70% |
| Particles finer than | 0.037 | mm: Max 10% |
| Stearic acid content | | : from 0.2 to 0.8% |
| Al-content | | : Min. 96% |
| Pulverized paraffin wax: | | |
| Melting point | | : approximately 55° C. |
| Particles coarser than | 0.71 | mm: negligible |
| Particles finer than | 0.25 | mm: negligible |

| Guar gum: Type: | M 207 | GFF |
|---|---|---|
| Finer than 0.074 mm | Min. 80% | |
| Finer than 0.180 mm | | Min. 95% |
| Viscosity in 1% solution in water containing AN | 7500 cps | 3500 cps |

Ammonium Nitrate:

-continued

| Type: | Porous prills | Dense prills |
|---|---|---|
| Coarser than 2 mm | 3,5% | abt. 60% |
| Between 2.0 and 0.5 mm | 96.0% | abt. 40% |
| Finer than 0.5 mm | 0.5% | abt. 0.2% |
| Anti-sintering treated | Yes | No |

In all examples, the ammonium nitrate is crushed by means of a pin-type mill. A cumulative sieve analysis curve has subsequently been interpolated between the two points lying closest to and at each side of the point where the curve intersects the line for 50% passage and the corresponding nominal light opening reported as the 50% point of the crushed material.

EXAMPLES 1 TO 4

With ammonium nitrate of the type of porous prills, crushed to a 50% point of about 0.140 mm the following explosive compositions have been prepared. During the mixing process, about one tenth of the ammonium nitrate has first been stirred with the liquid components, whereupon the remainder of the ammonium nitrate and the other components are added to the mixing operation. The amounts stated are in percent by weight of the total mixture.

| Example No. | 1 | 2 | 3 | 4 |
|---|---|---|---|---|
| Ethylene glycol | 5.0 | | | |
| Propylene glycol | | 5.0 | | |
| Glycol methyl ether[x] | | | 7,0 | |
| Formamide/Glycol ether,[xx] 1:1 mixture | | | | 7.0 |
| Al, type CB 180 VT | 1.0 | 1.0 | 1.0 | 1.0 |
| Guar, type M 207 | 1.5 | 1.5 | 1.5 | 1.5 |
| Paraffin wax | 2.5 | 2.0 | 1.0 | 1.5 |
| AN | 90.0 | 90.5 | 89.5 | 89.0 |
| Density, grams per $cm^3$ | 1.09 | 1.09 | 1.10 | 1.15 |
| Minimum initiation charge, size of blasting cap | 6 | 8 | 8 | 8 |
| at charge diameter mm | 40 | 40 | 40 | 40 |

[x]2-methoxy ethanol
[xx]2-ethoxy ethanol

These examples show that cap sensitivity can be obtained with as little as 1% of flake aluminium in combination with the liquid components referred to.

EXAMPLES 5 TO 8

Using the same amount of ammonium nitrate as in the examples 1 to 4 and the same process of preparation, the following explosive compositions have been prepared:

| Example No. | 5 | 6 | 7 | 8 |
|---|---|---|---|---|
| Ethylene glycol | 5.0 | | | |
| Propylene glycol | | 5.0 | | |
| Glycol methyl ether | | | 7.0 | |
| Formamide/glycol ether, 1:1 mixture | | | | 7.0 |
| Al, type CB 180 VT | 3.0 | 3.0 | 3.0 | 3.0 |
| Guar, type M 207 | 1.5 | 1.5 | 1.5 | 1.5 |
| Paraffin wax | 2.0 | 1.5 | 0.5 | 1.0 |
| AN | 88.5 | 89.0 | 88.0 | 87.5 |
| Density, grams per $cm^3$ | 1.15 | 1.15 | 1.15 | 1.15 |
| Minimum initiation charge, size blasting cap | 4 | 6 | 6 | 6 |
| at charge diameter mm | 22 | 32 | 32 | 32 |

These examples show that with 3% of flake aluminium in combination with the liquid components referred to, both the minimum initiation charge and the critical diameter are reduced in relation to the examples Nos. 1 to 4.

EXAMPLES 9 TO 11

In the same way as in the examples Nos. 1 to 8, the following explosive compositions have been prepared:

| Example No. | 9 | 10 | 11 |
|---|---|---|---|
| Ethylene glycol | 5.0 | 5.0 | |
| Formamide/glycol ether, 1:1 mixture | — | — | 7.0 |
| Al, type CB 180 VT | 3.0 | 5.0 | 5.0 |
| Al, type A 60-80 | 3.3 | — | — |
| Guar, type M 207 | 1.5 | 1.5 | 1.5 |
| Paraffin wax | 1.0 | 1.4 | 0.3 |
| AN | 86.2 | 87.1 | 86.2 |
| Density, grams per $cm^3$ | 1.15 | 1.15 | 1.15 |
| Minimum initiation charge, size of blasting cap | 4 | 4 | 6 |
| at charge diameter mm | 22 | 17 | 25 |

These examples show that with 5% of flake aluminium, a further reduction of the minimum initiation charge as well as of the critical diameter is obtained, but that atomized aluminium does not have the same sensitivity increasing effect.

Example 9, which has, in addition to flake aluminium, a considerable content of atomized aluminium, represents a comparatively energetic explosive composition.

EXAMPLES 12 TO 14

Using the same ammonium nitrate as in the previous examples, the following explosive compositions have been prepared:

| Example No. | 12 | 13 | 14 |
|---|---|---|---|
| Glycol methyl ether | 6.8 | 6.8 | |
| Formamide | | | 7.0 |
| Al, Alcoa 1651 | 3.0 | 3.0 | |
| Al, Alcoa 1663 | | | 3.0 |
| Guar, type M 207 | 1.5 | 1.5 | 1.5 |
| Paraffin wax | 0.5 | 0.5 | 1.0 |
| AN | 88.2 | 88.2 | 87.5 |
| Al and liquid stirred to a paste before addition | Yes | No | Yes |
| Al added last | No | Yes | No |
| Density, grams per $cm^3$ | 1.15 | 1.15 | 1.05 |
| Minimum initiation charge, size of blasting cap | 6 | 6 | 4 |
| at charge diameter mm | 32 | 32 | 25 |
| Brisance, dry, mm | 16.8 | 17.5 | 17.0 |
| Brisance, 1 hour in water, mm | 12.5 | 13.2 | 7.5 |
| Brisance, 2 hours in water, mm | 3.0 | 8.2 | 8.0 |

These examples show that the method of preparation does not have noticeable effects on the quality data, and also that the explosive compositions prepared retain a considerable share of their brisance after 2 hours as well as after 1 hour of being soaked in water.

EXAMPLES 15 TO 16

Using the same ammonium nitrate as in the previous examples, the following explosive compositions have been prepared, whereby flake aluminium is first dispersed in the liquid component to form a paste, whereafter the remaining components are added.

| Example No. | 15 | 16 |
|---|---|---|
| Ethylene glycol | 4.8 | — |
| Diglycol | — | 4.8 |
| Al, type CB 180 VT | 3.0 | 3.0 |
| Guar, type M 207 | 1.5 | 1.5 |
| Paraffin wax | 2.0 | 2.0 |

-continued

| Example No. | 15 | 16 |
|---|---|---|
| AN | 88.7 | 88.7 |
| Density, grams per $cm^3$ | 1.15 | 1.15 |
| Minimum initiation charge, size of blasting cap | 4 | 4 |
| at charge diameter mm | 17 | 22 |
| Brisance, dry, mm | 23.0 | 20.8 |
| Brisance, 1 hour in water, mm | 16 | 15.8 |
| Brisance, 2 hours in water, mm | 17 | 15.2 |

These examples show that also with as little as 3% of flake aluminium, very favourable values can be obtained for the minimum initiation charge and the critical diameter, at the same time as a considerable water resistance has been achieved.

EXAMPLES 17 TO 21

Using the same ammonium nitrate as in the previous examples, explosive compositions of the following compositions have been prepared:

| Example No. | 17 | 18 | 19 | 20 | 21 |
|---|---|---|---|---|---|
| Ethylene glycol | 4.3 | 4.3 | 4.3 | 4.3 | 4.3 |
| Al, type CB 105 VT | 3.0 | 3.0 | 3.0 | 3.0 | 3.0 |
| Al, type A 60-80 | 2.0 | 2.0 | 2.0 | 2.0 | 2.0 |
| Guar, type GFF | 1.5 | 1.5 | 1.5 | 0.75 | 0.0 |
| Paraffin wax | 1.7 | 0.85 | 0.0 | 1.7 | 1.7 |
| AN up to 100 | | | | | |
| Density | 1.15 | 1.15 | 1.15 | 1.15 | 1.15 |
| Brisance, dry, mm | 17.5 | 18.0 | 19.5 | 18.2 | 19.8 |
| Brisance, 1 hr in water mm | 14.8 | 15.0 | 14.2 | 7.0 | 0 |
| Brisance, 2 hrs in water mm | 14.8 | 15.2 | 13.5 | 7.0 | 0 |

These examples show that the paraffin wax improves slightly the water resistance of the explosive composition, and that the guar gum is absolutely decisive in that respect. It appears that a practical lower limit for obtaining effects in the water resistance lies around 0.5% guar. Contents of above 1.5% have not been tried, but if less efficient grades are used, presumably amounts of up to approximately 2.5% may be applicable.

EXAMPLES 22 TO 25

These examples represent combinations and methods of preparation having been effected in production equipment on a large scale, with charges weighing about 500 kg. Both of the previously mentioned grades of ammonium nitrate are represented, but the crushing process has been modified so that the crushed material in both cases shows very nearly the same 50%-point, viz., about 0.160 mm.

The flake aluminium is in advance (by the supplier) incorporated in a paste containing 40 parts of ethylene glycol and 60 parts of aluminium of the type CB 105 VT.

Ammonium nitrate and paraffin wax are charged first into the mixing machine with simultaneous addition of glycol. Finally, the Al paste, guar and atomized aluminium are added.

| Example No. | 22 | 23 | 24 | 25 |
|---|---|---|---|---|
| Ethylene glycol, added direct | 2.3 | 2.3 | 3.0 | 4.0 |
| Al/glycol paste | 5.0 | 5.0 | 5.0 | 10.0 |
| Guar, type M 207 | — | 1.5 | 1.5 | 1.5 |
| Guar, type GFF | 1.5 | — | — | — |
| Paraffin wax | 1.7 | 1.7 | 1.4 | 0.7 |

-continued

| Example No. | 22 | 23 | 24 | 25 |
|---|---|---|---|---|
| Al, type A 60-80 | 2.0 | 2.0 | 2.0 | — |
| AN, type porous prills, ground | — | — | 87.1 | 85.8 |
| AN, type dense prills, ground | 87.5 | 87.5 | — | — |
| Density, grams per $cm^3$ | 1.15 | 1.15 | 1.15 | 1.15 |
| Minimum initiation charge size of blasting cap | 4 | 4 | 4 | 4 |
| at charge diameter mm | 17 | 17 | 17 | 17 |
| Brisance, dry, mm | 17.0 | 17.0 | 20.0 | 22.0 |
| Brisance, 1 hour in water, mm | 16.0 | 15.0 | 18.0 | 20.0 |
| Brisance, 2 hours in water, mm | 16.0 | 11.0 | 18.0 | 18.0 |

The quality data set out represent typical and average data in the course of various production periods with the said raw materials. The explosive composition prepared, having a total Al content of from 5 to 6 percent, is comparatively energetic and has proved suitable as replacement of an explosive containing nitroglycerine. It retains its cohesive consistency during storage without any noticeable tendency to sinter. The explosive technical quality data registered, including the velocities of detonation in the range of from 3000 to 4000 m per second, show no systematic decline over a storage period of several months.

We claim:

1. A cap-sensitive powdered explosive composition having no explosive components and having ammonium nitrate as its single oxygen releasing component, characterized in that said explosive composition, in addition to ammonium nitrate and further optional components useful in explosive compositions, contains all of the following four components in amounts within the respective ranges, in percent by weight of the explosive composition:

(a) 3 to 8% of a combustible liquid consisting of one or more completely water soluble components, having a boiling temperature of above 120° C., and being capable of dissolving ammonium nitrate in amounts of between 20 grams and 100 grams per 100 grams of said liquid without reacting chemically with ammonium nitrate;

(b) 0.5 to 2.5% of a water blocking agent consisting of a high molecular weight polysaccharide having the property of imparting high viscosity to an aqueous, saturated ammonium nitrate solution;

(c) 0.5 to 3% of a water-insoluble wax or waxy substance in finely pulverized form;

(d) 1 to 6% of an aluminium powder the particles of which are in flake form and which have a specific surface of at least 5000 $cm^2$ per gram.

2. The powdered explosive composition of claim 1, characterized in that said combustible liquid component consists completely or essentially of a substance selected from the group consisting of formamide, ethylene glycol, diethylene glycol, propylene glycol, and 2-methoxy ethanol.

3. The powdered explosive composition of one of the claims 1 and 2, characterized in that said water blocking agent consists of galactomannans in the form of guar gum.

4. The powdered explosive composition of one of the claims 1 and 2, characterized in that said wax component consists of paraffin wax in finely pulverized form.

5. The powdered explosive composition of claim 3, characterized in that said wax component consists of paraffin wax in finely pulverized form.

6. The powdered explosive composition of claim 1, wherein said optional component useful in explosive compositions is atomized aluminium powder.

* * * * *